US007081078B2

(12) United States Patent
Bailey et al.

(10) Patent No.: US 7,081,078 B2
(45) Date of Patent: Jul. 25, 2006

(54) INFUSION PACKAGES AND CORRESPONDING MANUFACTURING METHODS

(75) Inventors: Thomas William Bailey, Conventry (GB); Paul Davis, Conventry (GB)

(73) Assignee: Molins PLC, Milton Keynes Bucks (GB)

( * ) Notice: Subject to any disclaimer, the term of this patent is extended or adjusted under 35 U.S.C. 154(b) by 252 days.

(21) Appl. No.: 10/169,978

(22) PCT Filed: Jan. 12, 2001

(86) PCT No.: PCT/GB01/00115

§ 371 (c)(1),
(2), (4) Date: Sep. 18, 2002

(87) PCT Pub. No.: WO01/51383

PCT Pub. Date: Jul. 19, 2001

(65) Prior Publication Data

US 2003/0059500 A1 Mar. 27, 2003

(30) Foreign Application Priority Data

Jan. 14, 2000 (GB) ..... 0000921.7

(51) Int. Cl.
*B31B 1/64* (2006.01)

(52) U.S. Cl. ..... 493/199; 493/223; 493/237

(58) Field of Classification Search ..... 493/199, 493/218, 223, 224, 226, 227, 228, 229, 232, 493/237

See application file for complete search history.

(56) References Cited

U.S. PATENT DOCUMENTS

| | | | | |
|---|---|---|---|---|
| 3,542,561 | A * | 11/1970 | Rambold | 426/79 |
| 4,715,271 | A * | 12/1987 | Kitagawa | 99/306 |
| 5,059,325 | A * | 10/1991 | Iida | 210/474 |
| 5,132,124 | A * | 7/1992 | Tamaki et al. | 426/82 |
| 5,312,318 | A * | 5/1994 | Vernon et al. | 493/194 |
| 5,842,408 | A * | 12/1998 | Hatta | 99/323 |

* cited by examiner

*Primary Examiner*—Sameh H. Tawfik
(74) *Attorney, Agent, or Firm*—Antonelli, Terry, Stout and Kraus, LLP.

(57) ABSTRACT

A method of manufacturing an infusion package 10 comprising a porous-walled container 12 for an infusible substance and a support for the container by means of which the container can be mounted on a rim of a drinking vessel. The method comprises (i) making cuts in at least one web of a semi-rigid material in a direction transverse to the web length to define a plurality of support members 14, each cut defining a first end 16 of one support member and a second end 20 of an adjacent support member such that the first end includes a projection 18 and the second end includes a recess 22 the cutting of which recess produces the projection; (ii) bringing two such support members into opposed relationship with the first end of one of the support members disposed opposite the second end of the other of the support members; (iii) positioning an end region of the container between the opposed support members; and (iv) securing that end region to the support members.

9 Claims, 3 Drawing Sheets

INFUSION PACKAGES AND CORRESPONDING MANUFACTURING METHODS

BACKGROUND OF THE INVENTION

The invention relates to infusion packages and particularly, but not exclusively, to infusion packages for coffee and to the manufacture of such packages.

Conventional infusion packages for tea or coffee comprise a porous-walled container into which has been charged the tea or coffee. In use such containers are immersed in hot liquid such as water. It is known to suspend an open container such as a bag in the liquid and this has been achieved using a hanging string. In other arrangements a filter bag is provided with holding members which enable the filter by to be supported from the rim of a container for the hot liquid. One such arrangement is described in EP-A-0463181. These known arrangement can be difficult to use and not straightforward to manufacture.

BRIEF SUMMARY OF THE INVENTION

The invention provides a method of manufacturing an infusion package comprising a porous-walled container for an infusible substance and a support for said container by means of which the container can be mounted on a rim of a drinking vessel, said method comprising (i) making cuts in at least one web of a semi-rigid material in a direction transverse to the web length to define a plurality of support members, each said cut defining a first end of one said support member and a second end of an adjacent said support member such that said first end includes a projection and said second end includes a recess the cutting of which recess produces said projection; (ii) bringing two said support members into opposed relationship with the first end of one said support member disposed opposite the second end of the other said member; (iii) positioning an end region of a said container between said opposed support members; and (iv) securing said end region to said opposed support members.

The invention also includes an infusion package comprising a semi-porous container for an infusible material and a support for said container, said support being secured to an end of said container so as to be pivotable between first, use, positions wherein the support projects generally upwardly of said container and second, non-use, positions in which the support is disposed alongside said container.

The invention also includes an infusion package comprising a porous walled container for an infusible substance and a support by which said container can be mounted on a rim of an drinking vessel, said support comprising two oppositely disposed members to which said container is attached such that, in use, it is suspended therefrom and each having a projection at one end thereof and a correspondingly shaped recess at an opposite end thereof, and said members being such that said projections project from opposite ends of said support.

The invention also includes an infusion package comprising a container for an infusible material and a support for said container having a projection at each end thereof by which the support can be seated on a rim of a drinking vessel, said support being defined by two support members disposed in opposed relationship and secured to one another at said ends and at least one of said supports having a zone of weakness whereby said support can be caused to deflect away from the other said support to provide an opening between said support members leading to an open end of said container.

BRIEF DESCRIPTION OF THE SEVERAL VIEWS OF THE DRAWINGS

In order that the invention may be well understood, some embodiments thereof, which are given by way of example only, will now be described with reference to the accompanying drawings, in which.

DETAILED DESCRIPTION OF THE INVENTION

Figure 4:
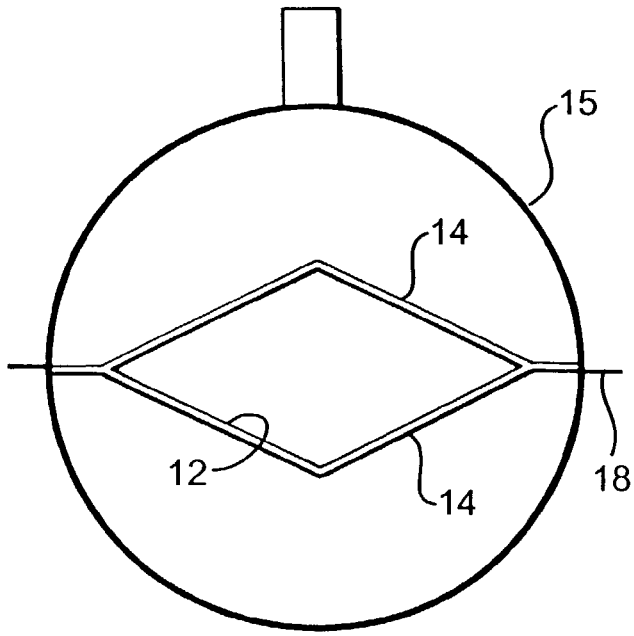
FIG. 4 is a schematic plan view of the infusion package in use.

Referring to FIGS. 1 to 5, an infusion package 10 comprises a container 12 and support for the container. The support comprises two support members 14 by means of which the container can be mounted on a rim of a drinking vessel such as a mug or cup 15 as shown in FIG. 4.

The support elements each consist of a strip of plastics coated board and are disposed opposite one another. Each support member is notched at one of its ends 16 to define a projection 18. The projection 18 lies in the plane of the support member and projects in the lengthwise direction of the member perpendicular to the end 16.

At the end 20 of the support members opposite the end 16, there is a recess 22. The recesses 22 are aligned with and correspond in shape to the respective projections 18.

As described in more detail hereinbelow, the support members are sealed to one another and to the container 12. The arrangement of the support members is such that the end 16 of one member is disposed opposite the end 20 of the other member so that the respective projections project in opposite directions.

Each support member has a score-line 24 in the inward facing one of its major surfaces. The score-lines are disposed midway between the ends 16, 20 and extend perpendicular to the lengthwise direction of the member and parallel to the ends 16, 20.

Figure 3:
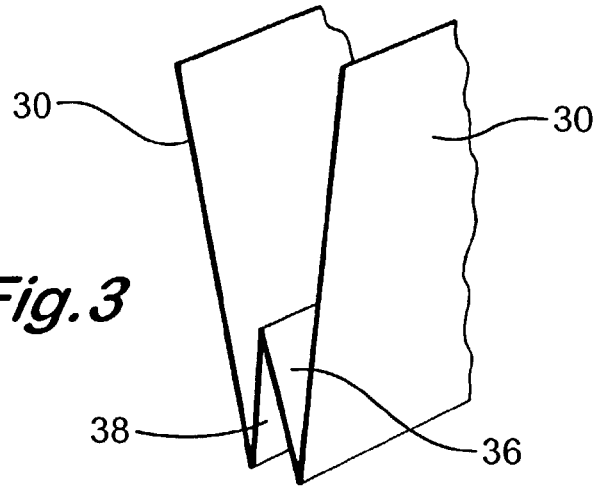
FIG. 3 is a perspective view of a W-section web of heat sealable porous material from which the bag portion of the package is made.

The container is in the form of an open-ended sack, or bag, 12. The bag comprises a web of porous heat sealable material, which is folded to produce a cross-section, which is generally W-shaped as shown in FIG. 3. The long sides 30 of the W are sealed to each other by edge seals 32 (FIG. 1) which extend from the upper to the lower end of the bag. The edge seals are interconnected by transverse seals 34 running along the lower end of the bag. The lower corners are rounded as shown at 35 in order to minimise drippage of liquid from the bag. The transverse seals run in parallel and are made between the internal surfaces 36 of the central portion of the W and the opposed surfaces of the long sides 30. The transverse seals do not seal the external surfaces 38 of the central portion to one another. This sealing arrangement provides the bag with an inwardly directed gusset at its lower end, which increases the volume of the bag. This can be seen in FIG. 2 which shows that the bag is wider at its lower end than at the upper end where it is joined to the support members.

Figure 5:
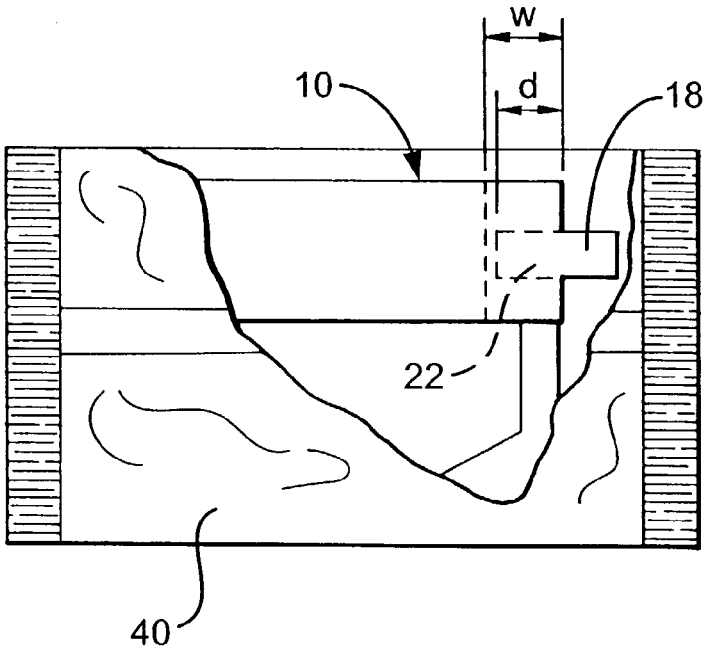
FIG. 5 is a cutaway view of a sachet containing the infusion package of FIG. 1.

The upper, open, end of the bag is sandwiched between the support members. The external surfaces of the bag at the open end are secured to the opposed inwardly facing surfaces of the support members 14 in an arrangement which, as best seen in FIG. 4, leaves the bag open at the upper end. The support members 14 are sealed to one another at their ends 16, 20 by respective edge seals which extend parallel to the score-lines 24. As shown in FIG. 5, the width w of the edge seals is greater than the depth d of the recesses 22.

The bag 12 contains an infusible material such as tea or coffee. When the infusible material is coffee, it is preferable that the package is supplied in a hermetically sealed sachet 40 as shown in FIG. 5. The sachet may be in the form of a standard pillow pack as illustrated. The infusion package is packed in the sachet with the support members folded over so that it is disposed alongside the upper end of the bag 12. This has the advantages that the size of sachet required is reduced and the open end of the bag is effectively closed so that the coffee will not spill out in transit.

Figure 1:
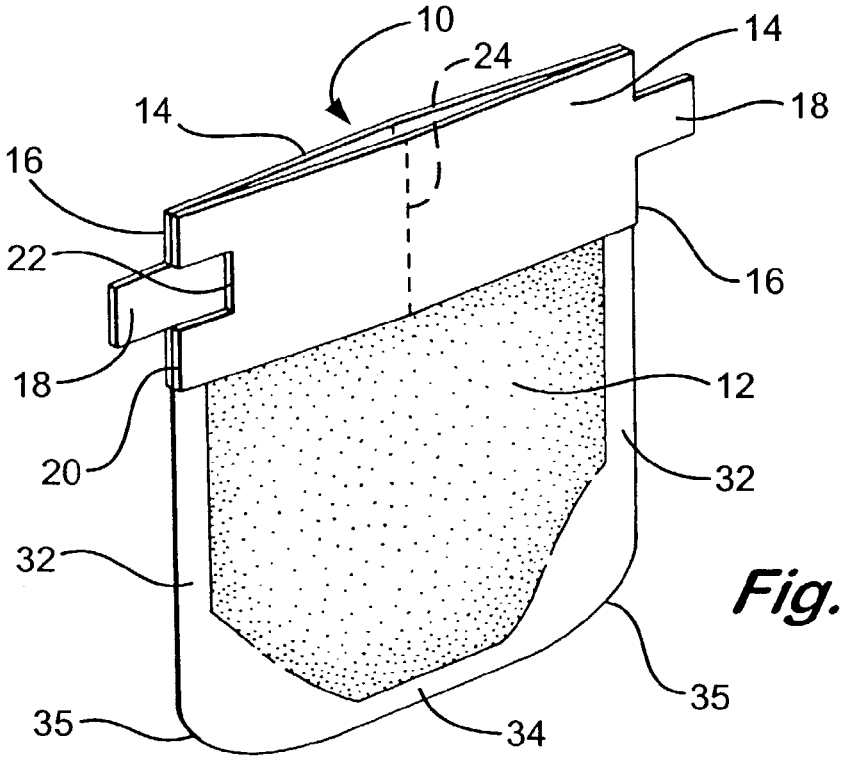
FIG. 1 is a perspective view of an infusion package.
Figure 2:
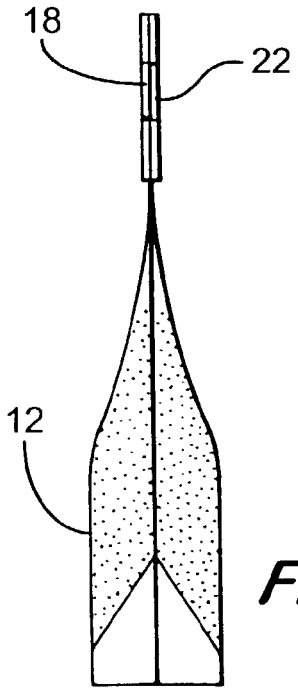
FIG. 2 is an end view of the infusion package.

In use, the bag is removed from the sachet and the support members are folded upwardly to bring the infusion package into the condition shown in FIG. 1. A compressive force is applied to the ends of the support member causing the members to bow outwardly in the region of the score-lines 24. As shown in FIG. 4, the result is that the support members adopt a diamond configuration allowing the projections 18 to seat on the rim of a drinking vessel 15. In addition, the bowing of the support members opens the upper end of the bag and provides an opening through which water can be poured onto the coffee contained in the bag. It will be appreciated that the compressibility of the support members provides the additional advantage that the support can be manipulated to fit drinking vessels of varying diameters.

Figure 6:
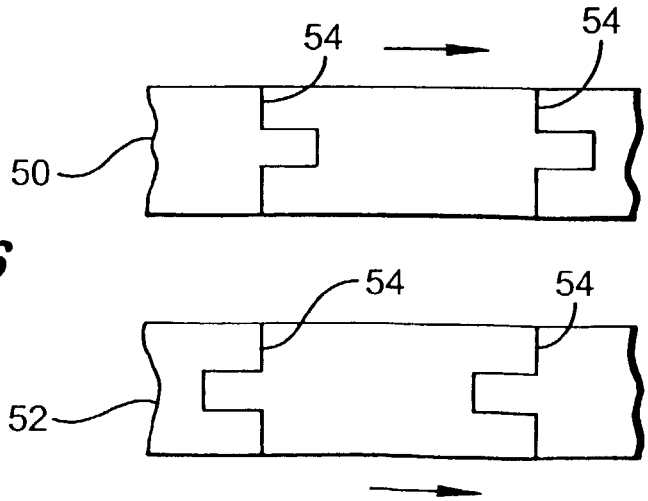
FIG. 6 is a plan view of two webs illustrating a method of making the support members of the infusion package of FIG. 1.

Manufacture of the support members will now be described with reference to FIG. 6. In a preferred arrangement, the supports are made from support members taken from two webs 50, 52.

The support members are produced by making transverse cuts 54 in the web at intervals corresponding to the desired length of the support members. The transverse cuts extend from one side of the web to the other and each defines the end 16 of one member and the end 20 of the following member so that the projection 18 of one member is produced by the cut which also produces the recess of the next member. It will be appreciated that this arrangement allows the production of the support members without any material wastage.

The webs 50, 52 move in the same direction and the cuts 54 are arranged such that the projections produced in the web 50 point in the direction of movement of the web, whilst the projections produced in the web 52 point in the direction opposite the direction of movement. To produce a support, a support member a support member from the web 50 is brought into opposed relationship with a support member from the web 52. It will be appreciated that by having the projections of the two webs pointing in opposite directions, the two support members can readily be brought into opposed relationship to produce a support having its two projections pointing in opposite directions without any complicated turning movements. It will also be appreciated that although, the webs are shown moving in an edge-to-edge relationship which would require rotation of at least one of the support members about its longitudinal axis, the webs could be cut whilst running in a face-to-face relationship so that subsequent to the cutting process, all that would be required is to move the opposed faces of the web into contact with one another.

The support members from the two webs may be secured to one another by heat sealing. Preferably, at least one side of the webs from which the support members is made is coated with a heat sealable material so that sealing process simply involves pressing the two members together and applying heat to obtain a seal. Alternatively, a hot melt adhesive may be painted onto one or both webs in a suitable pattern to produce the required arrangement of seals. A further alternative is to apply an adhesive such as a food compatible paste to one of the webs.

The cutting process may be partial so that the respective support members of the two webs are finally separated from one another at an assembly position downstream of the cutting position.

An alternative support for the infusion package and a method of manufacture therefor will now be described with reference to FIGS. 7 and 8.

Figure 7:
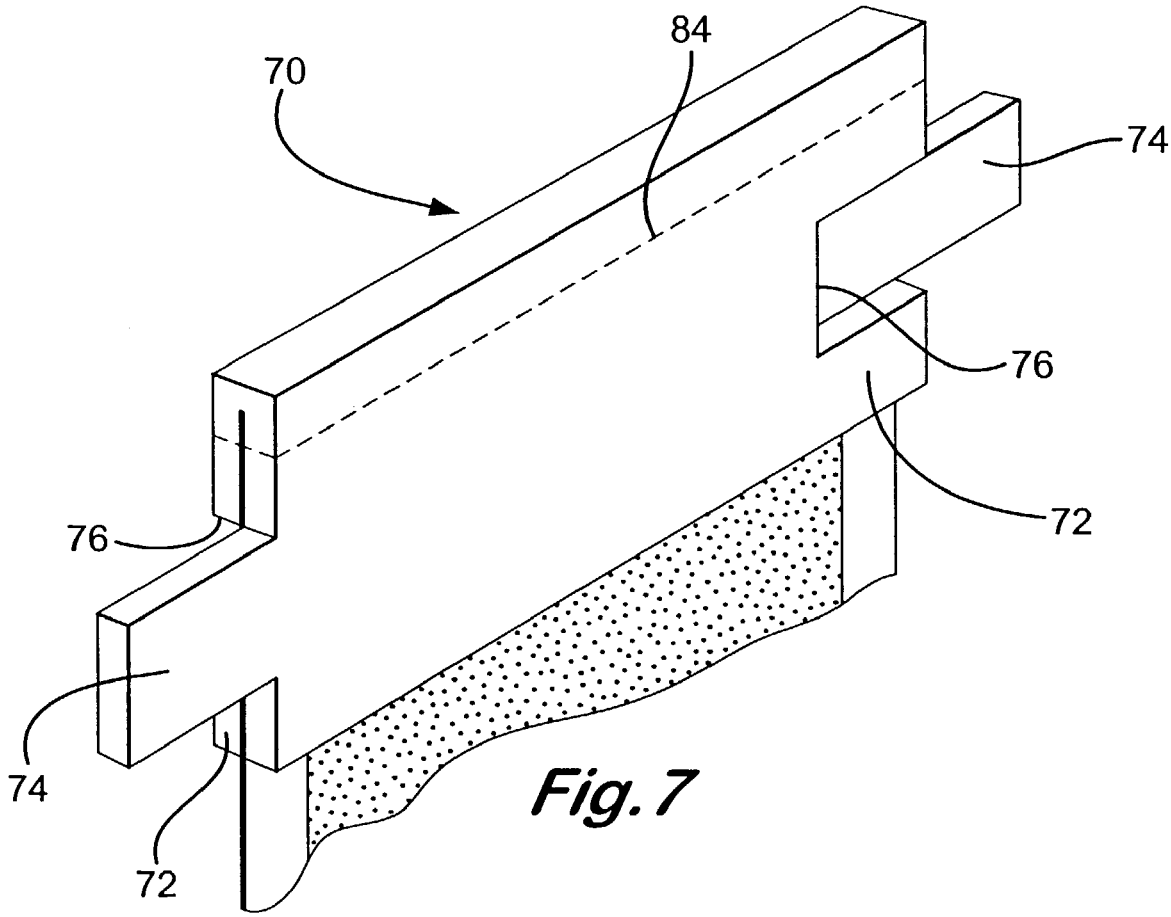
FIG. 7 is a perspective view of an alternative support for an infusion package.

Referring to FIG. 7, an alternative support 70 for the infusion package, comprises integral support members 72. The support members have projections 74 and recesses 76 corresponding to the projections and recesses of the support members 72 and are made from a single web 78 (FIG. 8) of plastics coated board folded about its longitudinal axis 80 so as to have a generally U-shaped cross-section.

Figure 8:
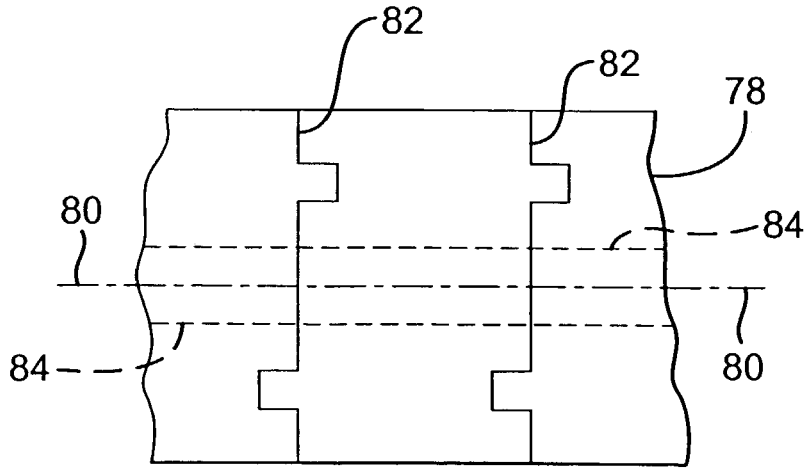
FIG. 8 a plan view of a web illustrating a method of making the support shown in FIG. 7.

As shown in FIG. 8 the support members 72 of the support 70 are produced by making transverse cuts 82 in the web 78 at intervals corresponding to the desired length of the support members. The transverse cuts extend from one side of the web to the other and each defines the end of one support 70 and the end of the following support so that the projections produced at each end of the support are produced by the cuts which also produce the recesses in the adjacent end of the neighbouring supports. Subsequent to the cutting operation, the support members are brought into an opposed relationship to define the U-section support by folding the web about its axis 80. The support members can then be secured to one another by sealing or gluing as described above.

It will be appreciated that the closed top of the support 70 prevents spillage of the infusible material contained in the bag. The support may formed with perforations 84 to permit the top to be removed to allow water to be poured onto the infusible material. Alternatively, in a manufacturing process in which the support 70 is secured to the bag before the bag is filled with the infusible material, the perforations can be used to permit the top of the support to be removed to allow a dose of the infusible material to be dropped into the bag through the support. It will be appreciated that in such a process, a zone of weakness provided by, for example score-lines as shown in FIG. 1, is required to permit the support members to bow outwardly in response to suitable manipulation or the application of a suitable force to produce a suitable opening through which the infusible material can pass.

It will be understood that the support 70 can be pivoted relative to the bag in the same way as the support of the infusion package 10.

The invention claimed is:

1. A method of manufacturing an infusion package comprising a porous-walled container for an infusible substance and a support member for said container by means of which the container can be mounted on a rim of a drinking vessel, said method comprising (i) making cuts in at least one web of a semi-rigid material in a direction transverse to the web length to define a plurality of support members, each of said cuts defining a first end of one said support member and a second end of an adjacent said support member such that said first end includes a projection extending in a longitudinal direction of said one said support member and said second end includes a recess extending in a longitudinal direction of said adjacent support member, the cutting of which recess produces said projection; (ii) bringing two said support members into opposed relationship with the first end of one said support member disposed opposite the second end of the other said member; (iii) positioning an end region of a said container between said opposed support members; and (iv) securing said end region to said opposed support members.

2. A method as claimed in claim 1, wherein said projections correspond in shape to said recesses.

3. A method as claimed in claim 1, comprising providing each said support member with a zone of weakness intermediate said first and second ends.

4. A method as claimed in claim 3, wherein said zone of weakness is provided by a score-line extending parallel to said ends.

5. A method as claimed in claim 4, wherein said container is a bag having an opening at one end and said opening is defined by said end region.

6. A method as claimed in claim 4, comprising making said cuts in two said webs, wherein said one support member is defined by making said cuts in a first of said two webs and said other support member is defined by making cuts in a second of said two webs.

7. A method as claimed in claim 6, wherein said webs move in a common direction and said cuts in said first web are arranged such that said projections project in said common direction and said cuts in said second web are arranged such that said projections project in a direction opposite said first direction.

8. A method as claimed in claim 1, said support members are integral, said cuts being made in a single web which is folded so as to provide a fold that extends along a longitudinal axis thereof to bring said integral support members into said opposed relationship.

9. A method as claimed in clam 8, comprising providing perforations in the region of said fold.

* * * * *